United States Patent [19]

Rochette

[11] Patent Number: 4,593,162

[45] Date of Patent: Jun. 3, 1986

[54] DEVICE FOR CONTROLLING AN ELECTRICAL SIGNAL BY AN ADJUSTABLE PLUG

[75] Inventor: Gérard Rochette, Mantes la Ville, France

[73] Assignee: U.S. Philips Corporation, New York, N.Y.

[21] Appl. No.: 643,228

[22] Filed: Aug. 22, 1984

[30] Foreign Application Priority Data

Aug. 31, 1983 [FR] France ..... 83 13987

[51] Int. Cl.[4] ..... H01H 19/00

[52] U.S. Cl. ..... 200/51.09; 200/51 R; 200/61.39; 200/61.59; 200/336

[58] Field of Search ..... 200/51.05, 51.09, 153 S, 200/51.07, 51 R, 336, 61.39, 61.59, 330, 331

[56] References Cited

U.S. PATENT DOCUMENTS

| | | | |
|---|---|---|---|
| 2,986,705 | 5/1961 | Showalter | 330/65 |
| 3,222,471 | 12/1965 | Steinkamp | 200/51.07 |
| 3,657,496 | 4/1972 | Davidson | 200/336 |

*Primary Examiner*—Stephen Marcus
*Assistant Examiner*—Renee S. Luebke
*Attorney, Agent, or Firm*—Joseph P. Abate

[57] ABSTRACT

A connection socket (11) includes an electrical component (16) having a control shaft (18, 35) which is coaxial with a rotatable cylindrical plug (12) in a recess (19) of the connection socket (11). The component (16) can be adjusted by rotation of the plug (12) which engages a coupling member (30) on the control shaft (18, 35) of the component (16).

5 Claims, 3 Drawing Figures

DEVICE FOR CONTROLLING AN ELECTRICAL SIGNAL BY AN ADJUSTABLE PLUG

BACKGROUND OF THE INVENTION

The invention relates to a device for controlling an electrical signal supplied to the device. More particularly, the invention relates to such a device including a connection socket having a cylindrical recess and also having contact springs for establishing an electrical contact with a cylindrical plug adapted to be received by the cylindrical recess, and further including means for adjusting a rotary control shaft of an electrical component for controlling the electrical signal.

Numerous radio receivers, television receivers or sound reproducing devices comprise one or several connection sockets of the type generally designated as "jacks" (for example, for the output of an audio signal). The connection socket can be provided as the only output of the signal of an apparatus or also as auxiliary output for the signal when the apparatus itself comprises its own reproducing means, notably one or several loudspeakers in the case of sound reproduction.

In all cases, it is necessary in practice to provide a capability for controlling the signal supplied by the connection socket. Such capability is used, for example, for controlling the sound volume and/or the balance in the case of stereophonic signals. A technical solution consists of a control by means of a control knob on the front side of the apparatus. The control is common to the operation of the apparatus in the autonomous mode and to the operation at the auxiliary output. However, this solution is not satisfactory in all circumstances because, for technical reasons or for reasons of commodity, it may be desirable to have a particular control of the signal coming from the auxiliary connection socket. By way of example, the case may be mentioned of a television apparatus which has its own loudspeakers for the sound reproduction and an auxiliary connection socket for an ear-phone. Depending upon the operating conditions, it may be desired that one of the users prefers the ear-phone with a given sound volume and that other users listen simultaneously to the sound reprduced by the loudspeakers of the television apparatus with a sound volume chosen independently of that of the ear-phone. It will then be necessary to utilize a supplementary control for the auxiliary connection socket.

Thus, a considerable increase of the number of control knobs results which not only renders the use of the apparatus more complicated for the user, but also prohibits a further miniaturization of the apparatus and influences its price.

It is known from U.S. Pat. No. 2,986,705 to obtain a control of the signal by a rotatable knob which is coaxial with the connection socket and which transmits through the front of the apparatus the control movement to one or several electrical components by means of gears. Certainly, this solution permits a desirable reduction of the size of the apparatus, but it nevertheless requires a comparatively large number of mechanical parts which results in a price limiting its use. A further disadvantage of the known device with respect to its ease of employment for the user can also be mentioned. Specifically the user has to operate the control knob, while the body of the plug projecting at its center makes the operation somewhat difficult.

SUMMARY OF THE INVENTION

The invention has for its object to provide a control device which eliminates these difficulties to a considerable extent.

A device according to the invention is characterized in that the control shaft of the electrical component is mechanically coupled to the cylindrical plug in a manner such that its axis substantially coincides with the axis of the recess of the connection socket and the axis of said plug, the control being effected by simultaneous rotation of the plug and the control shaft. This device will have a double function with respect to the plug: the plug serves as an immovable connection by its insertion into the connection socket in a known manner, and it serves as a control member for controlling the signal by rotation while it is depressed into the connection socket. It provides the advantage that a separate control member is no longer necessary and that a reduction of the dimensions of the apparatus can be obtained.

In a further embodiment, the device according to the invention is characterized in that a coupling member of the control shaft of the component comprises a cavity with grooves which engage corresponding grooves arranged on a free end of the plug.

The control shaft of the electrical component is driven in a slip-free manner which is useful in the event that the torque necessary for the rotation is comparatively large.

According to a still further embodiment of the invention the control shaft of the component comprises a friction member which is biased against the free end of the plug. Such a device is of particular advantage when the electrical component requires only a small torque. In this case, the device can be utilized with a plug of a standardized type.

Advantageously, it is ensured that the rotation of the control shaft of the electrical component is effective only when a small depression force is exerted on the plug. In its operating position, the end of the plug is decoupled from the control shaft because the plug recoils slightly.

Thus, a compulsory rotation of the plug, for example resulting from an action of the connection cable, does not modify the control.

BRIEF DESCRIPTION OF THE DRAWING

In order that the invention may be readily carried out, it will now be described more fully, by way of example, with reference to the accompanying drawing, in which.

DESCRIPTION OF THE PREFERRED EMBODIMENTS

Figure 1:
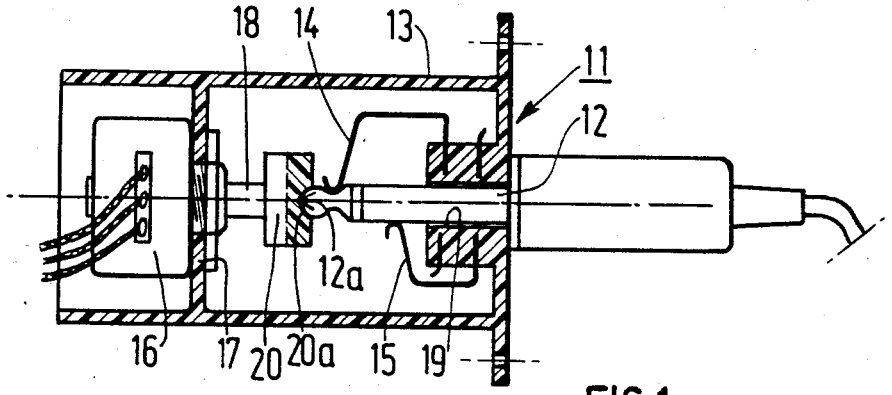
FIG. 1 is a longitudinal cross-sectional view of an embodiment of a device according to the invention.

The device shown in FIG. 1 comprises a connection socket 11 (i.e. jack) for a plug 12 with a single cylindrical pin. The connection socket 11 comprises a casing 13 of insulating material, preferably moulded material, which carries blade springs 14, 15 which permit establishing required electrical contacts with the plug 12 by lateral force on the latter according to a conventional technique. The casing 13, moreover, comprises means for fixing an electrical component (e.g. a potentiometer) 16 for controlling an electrical signal supplied to the connection socket 11. The fixing means includes, by way of example, a separation wall 17 arranged so that the control shaft 18 of the potentiometer 16 is coaxial with respect to a center line of a cylindrical recess 19 of the connection socket 11. The control shaft 18 of the potentiometer 16 has secured on it a disk shaped coupling member 20 which comprises a front cavity 20*a* in which the free end of the plug 12 is engaged when this plug 12 is depressed into the connection socket 11.

Thus, when the plug 12 is in its position in the connection socket 11, it not only plays its role of an electrical contact in the usual manner, but according to the invention it permits also the control of the potentiometer 16 by rotation of the body of the plug 12. In order to ensure the coupling of the coupling member 20 with the free end of the plug 12, grooves 12*a* are provided on the end of the plug 12 and corresponding grooves are provided in the cavity 20*a* of the coupling member 20.

Figure 2:
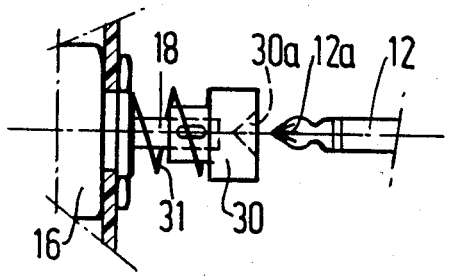
FIG. 2 is a partial cross-sectional view relating to a variation of a detail of the device shown in FIG. 1.

FIG. 2 is a partial cross-sectional view of a modification of the embodiment of FIG. 1 which is preferred in the case in which the free end of the plug 12 has parts which form the grooves 12*a*. According to this modification, a coupling member 30, although it is arranged so as to be rotated simultaneously with the control shaft 18 of the potentiometer 16, can translate relatively to control shaft 18 by means of a spring 31 acting in the direction of the plug 12. In FIG. 2, the free end of the plug 12 is shown in a position in which it is not yet entirely depressed into the connection socket 11. When the plug 12 is normally depressed, the coupling member 30 is slightly displaced and, thus, remains in pressure contact with the plug 12 under the biasing force of the spring 31. Thus, the parts forming grooves 12*a* of the end of the plug 12 remain perfectly coupled with the grooves in the cavity 30*a* of the coupling member 30. The control of the signal can be obtained without failure even if the torque of the potentiometer is not very small.

Figure 3:
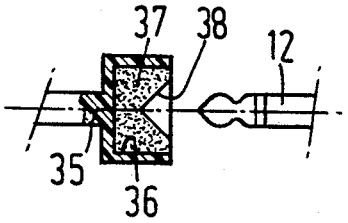
FIG. 3 shows a detail of a further embodiment of a device according to the invention.

FIG. 3 is a partial cross-sectional view of a further embodiment of the invention in which a control shaft 35 of the electrical component 16 comprises a chamber 36 in which a friction member 37 of an elastomer, for example, caoutchouc, is fixed. The front end of the friction member 37 has a recess 38 in which the free end of the plug 12 is to be supported. In FIG. 3, the plug 12 is shown in a position in which it is not entirely depressed into the connection socket 11. Advantageously, according to this embodiment, it is ensured that the electrical component is only set into rotation if the user exerts a small axial pressure on the plug 12 while causing the rotation for the control to be effected. When the user releases the plug 12, the plug is no longer sufficiently supported in the recess 38 of the friction member 37 to cause the friction to set the control shaft 35 into rotation. An accidental rotation of the plug 12, for example under the influence of its connection cable, does not modify the control.

Experience has shown that, if the electrical component 16 requires only a comparatively small torque, it is not necessary to provide grooves on the end of the plug 12. The friction of the friction member 37 is then sufficient. Thus, a plug 12 of a current standard model can be used without any modification of the latter. The embodiments described so far were adapted for the control of the sound volume with respect to an earphone for a monophonic signal. Of course, the invention may also be utilized with a stereophonic signal both for the control of the sound volume and for the control of the balance. The slight modifications necessary for these applications do not give rise to difficulties for those skilled in the art.

In the embodiments, the case is described of a control by means of a potentiometer. However it will be appreciated that the invention may also be used in the case of several potentiometers coupled to the same shaft, and more generally for any electrical component for controlling the signal supplied by the connection socket 11 so that then these components are controlled by rotation of a single shaft.

What is claimed is:

1. A device for rotating a shaft, comprising:

a casing forming a cylindrical recess and also forming an opening communicating with the recess;

a cylindrical plug including a free end having parts forming grooves, the plug being disposed within the opening and the recess;

a plurality of contact springs electrically contacting the plug;

an electrical component disposed within the recess, the component having a rotatable shaft coaxial with the plug;

a coupling member fixed on the rotatable shaft, the coupling member having a cavity in which the free end is disposed, the coupling member further having grooves communicating with the cavity, the grooves of the coupling member being engaged by the parts of the free end, so that a rotation of the plug causes a rotation of the rotatable shaft.

2. A device as claimed in claim 1, further comprising means for fixing the electrical component to the casing, and a spring disposed on the rotatable shaft, the spring being arranged for biasing the coupling member toward the free end of the plug.

3. A device for rotating a shaft, comprising:

a casing forming a cylindrical recess and also forming an opening communicating with the recess;

a cylindrical plug including a free end, the plug being disposed within the opening and the recess;

a plurality of contact springs electrically contacting the plug;

an electrical component disposed within the recess, the component having a rotatable shaft coaxial with the plug;

a coupling member fixed on the rotatable shaft, the coupling member having a chamber; and a friction member provided in the chamber, the free end of the plug being in engagement with the friction member.

4. A device as claimed in claim 3, wherein the friction member is an elastomer.

5. A device as claimed in claim 3, further comprising means for fixing the electrical component to the casing, and a spring disposed between the fixing means and the coupling member, the spring being arranged for biasing the coupling member toward the free end of the plug.

* * * * *